US008651901B2

(12) United States Patent
Beck, Jr. et al.

(10) Patent No.: US 8,651,901 B2
(45) Date of Patent: Feb. 18, 2014

(54) ELECTRICAL CONNECTOR HAVING TERMINAL POSITION ASSURANCE

(75) Inventors: Hoy Smith Beck, Jr., Lexington, NC (US); John Raymond Shuey, Mechanicsburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 35 days.

(21) Appl. No.: 13/463,441

(22) Filed: May 3, 2012

(65) Prior Publication Data

US 2012/0282800 A1 Nov. 8, 2012

Related U.S. Application Data

(60) Provisional application No. 61/482,544, filed on May 4, 2011.

(51) Int. Cl.
*H01R 13/514* (2006.01)

(52) U.S. Cl.
USPC ..... 439/752; 439/595

(58) Field of Classification Search
USPC ..... 439/752, 595
See application file for complete search history.

(56) References Cited

U.S. PATENT DOCUMENTS

| | | | | | |
|---|---|---|---|---|---|
| 5,520,553 | A * | 5/1996 | Cecil et al. | 439/595 |
| 5,575,692 | A * | 11/1996 | Cecil et al. | 439/752 |
| 5,816,856 | A * | 10/1998 | Kamath et al. | 439/595 |
| 5,989,066 | A * | 11/1999 | Cox | 439/595 |
| 6,045,404 | A * | 4/2000 | Myer | 439/595 |
| 6,116,953 | A * | 9/2000 | Myer | 439/595 |
| 6,599,150 | B1 * | 7/2003 | Martin et al. | 439/595 |
| 6,648,700 | B1 * | 11/2003 | Greiner et al. | 439/752 |
| 6,755,688 | B2 * | 6/2004 | Hall et al. | 439/595 |
| 6,913,494 | B2 * | 7/2005 | Ward et al. | 439/752 |
| 7,063,578 | B2 * | 6/2006 | Goto | 439/752 |
| 7,066,773 | B1 * | 6/2006 | Martin | 439/752 |
| 7,278,883 | B2 * | 10/2007 | Tyler | 439/595 |
| 7,384,309 | B1 * | 6/2008 | Morello et al. | 439/595 |
| 7,670,177 | B2 * | 3/2010 | Myer et al. | 439/595 |
| 7,867,028 | B2 * | 1/2011 | Brown | 439/595 |
| 7,867,042 | B2 * | 1/2011 | Shuey | 439/752 |
| 7,988,489 | B2 * | 8/2011 | Schmitt et al. | 439/595 |
| 8,231,409 | B2 * | 7/2012 | Lebrun et al. | 439/595 |
| 8,262,410 | B2 * | 9/2012 | Campbell et al. | 439/595 |
| 8,376,778 | B2 * | 2/2013 | Obata et al. | 439/595 |
| 8,419,471 | B2 * | 4/2013 | Suzuki et al. | 439/595 |
| 8,475,207 | B2 * | 7/2013 | Obata et al. | 439/595 |
| 2002/0016106 | A1 * | 2/2002 | Okayasu et al. | 439/595 |
| 2002/0064994 | A1 * | 5/2002 | Tachi | 439/595 |
| 2003/0027455 | A1 * | 2/2003 | Yamawaki et al. | 439/595 |

(Continued)

OTHER PUBLICATIONS

International Search Report, International Application No. PCTUS2012/036436, International Filing Date, Apr. 5, 2012.

*Primary Examiner* — Ross Gushi

(57) ABSTRACT

An electrical connector is disclosed having a housing having at least one row of terminal receiving passageways. Each passageway includes a locking latch. An overstress protection rib is positioned below each latch. A channel extends through a front wall of the housing and adjacent to the at least one row of terminal receiving passageways, and on the opposite side of the latch. A terminal position assurance member (TPA) has a pre-locked position with the TPA positioned forward of the latch allowing the latch to resile into the channel, and a fully locked position where the TPA is positioned underneath the latch.

11 Claims, 8 Drawing Sheets

(56) References Cited

U.S. PATENT DOCUMENTS

| | | | | |
|---|---|---|---|---|
| 2004/0023564 | A1 | 2/2004 | Yamamoto et al. | |
| 2004/0067686 | A1* | 4/2004 | Nimura | 439/595 |
| 2005/0085126 | A1* | 4/2005 | Sagawa et al. | 439/595 |
| 2005/0112943 | A1* | 5/2005 | Sagawa et al. | 439/595 |
| 2005/0124216 | A1* | 6/2005 | Sagawa et al. | 439/595 |
| 2005/0186842 | A1* | 8/2005 | Fukatsu et al. | 439/595 |
| 2005/0250385 | A1* | 11/2005 | Tsuji | 439/595 |
| 2006/0003631 | A1* | 1/2006 | Fukatsu et al. | 439/595 |
| 2006/0141862 | A1* | 6/2006 | Machida et al. | 439/595 |
| 2006/0160420 | A1* | 7/2006 | Takahashi | 439/595 |
| 2006/0240718 | A1* | 10/2006 | Osada et al. | 439/752 |
| 2006/0281373 | A1* | 12/2006 | Anbo et al. | 439/752 |
| 2007/0020997 | A1* | 1/2007 | Miyakawa | 439/595 |
| 2007/0275599 | A1* | 11/2007 | Sugiyama et al. | 439/595 |
| 2009/0311896 | A1 | 12/2009 | Myer et al. | |
| 2012/0282800 | A1* | 11/2012 | Beck et al. | 439/378 |

* cited by examiner

ELECTRICAL CONNECTOR HAVING TERMINAL POSITION ASSURANCE

CROSS REFERENCE TO RELATED APPLICATIONS

This application claims priority to and the benefit of the filing date of U.S. Provisional Application No. 61/482,544, filed on May 4, 2011, entitled "Electrical Connector Having Terminal Position Assurance," which is hereby incorporated by reference in its entirety.

BACKGROUND

The present application relates to an electrical connector and more particularly to an electrical connector having a terminal position assurance device (TPA).

It is known in various industries to have electrical connectors in the form of plugs and headers to provide electrical connection in such systems as automotive systems, for example, for engine electronics, engine control management systems and the like. It is also known to have "anti-scooping" devices such as posts or ribs (see U.S. Pat. No. 6,409,525) which prevent electrical connection of mating connectors at an angle other than along a common longitudinal axis. Typical anti-scooping ribs are inserted adjacent the terminal cavity. Current connectors may also use a terminal assurance member (TPA) to assure that the terminal is properly positioned in the cavity. For connectors having a front loaded TPA, the TPA is inserted adjacent the terminal cavity. Many current electrical connectors have a space adjacent to the terminal cavities to accommodate the TPA. Additionally, many current connectors may have more than one row of terminal cavities. Consequently, in connectors using a front loaded TPA, space is needed for both the TPA and the anti-scooping rib. The problem is that in some current connectors having closely spaced terminal cavities, the space is not available for both the typical TPA and anti-scooping rib.

SUMMARY

An electrical connector comprises a housing having a plurality of terminal receiving passageways positioned in at least one row, the passageways including a locking latch. An overstress protection rib positioned adjacent each latch. A channel extends through the housing and adjacent to the at least one row of terminal receiving passageways. The electrical connector includes a terminal position assurance member (TPA) having a blade. The blade includes a plate and a rear edge. The blade is positioned within the channel so that the terminal position assurance member has a pre-locked position with the rear edge positioned forward of the latch allowing the latch to resile into the channel, and a fully locked position where the rear edge is positioned underneath the latch.

DETAILED DESCRIPTION

Figure 1:
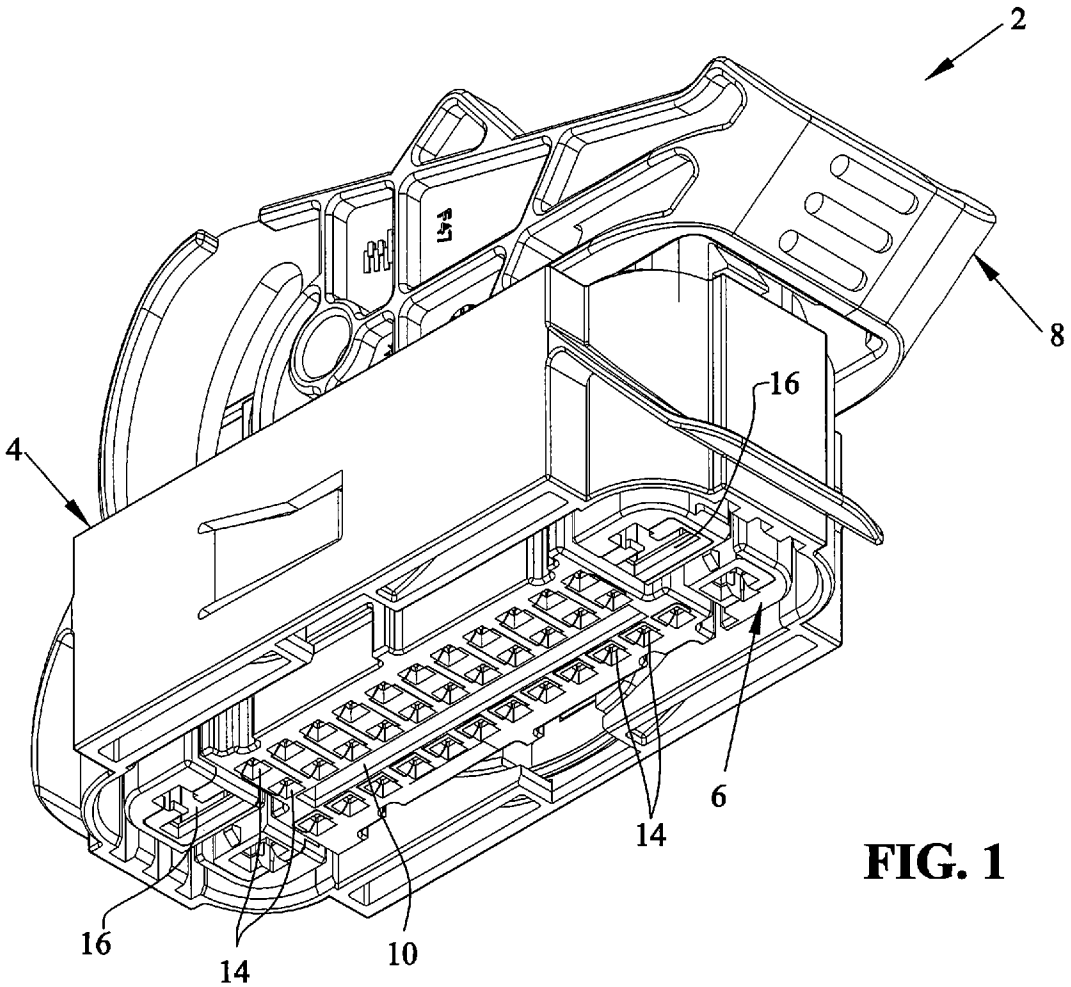
FIG. 1 shows an underside perspective view of the plug assembly of the present disclosure.
Figure 2:
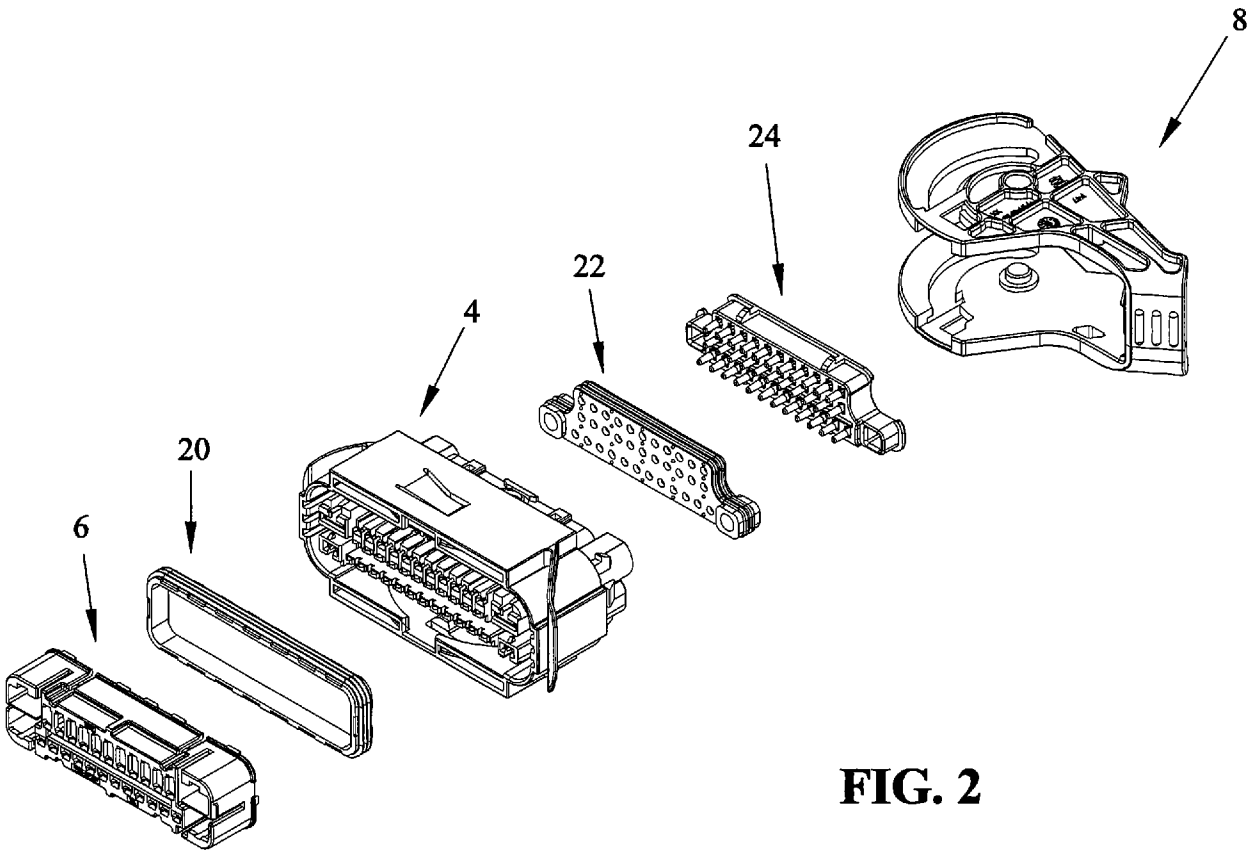
FIG. 2 shows an exploded of the plug assembly of FIG. 1.

With reference to FIGS. 1 and 2, an exemplary embodiment of the electrical connector assembly of the present disclosure is shown generally at 2 including a plug housing 4 preferably molded from an electrically insulating material such as a plastic material, a terminal position assurance member (TPA) 6, and a mating assist member 8 in the form of a lever. As shown, connector assembly 2 includes an opening 10 formed therethrough for receiving a laterally extending anti-scooping rib as described herein. In the exemplary embodiment, the connector assembly 2 includes a plurality of terminal receiving passageways shown generally at 14 for signal contacts and one or more terminal receiving passageways such as 16 for power contacts. In the exemplary embodiment, the terminal receiving passageways 14 are positioned in at least one row. The connector assembly 2 further includes peripheral seal 20, rear wire seal 22 and rear housing portion 24.

Figure 3:
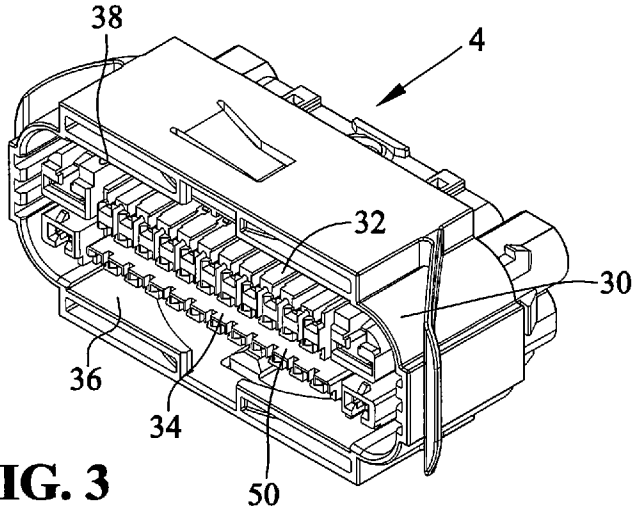
FIG. 3 shows a front perspective view of the plug housing.
Figure 4:
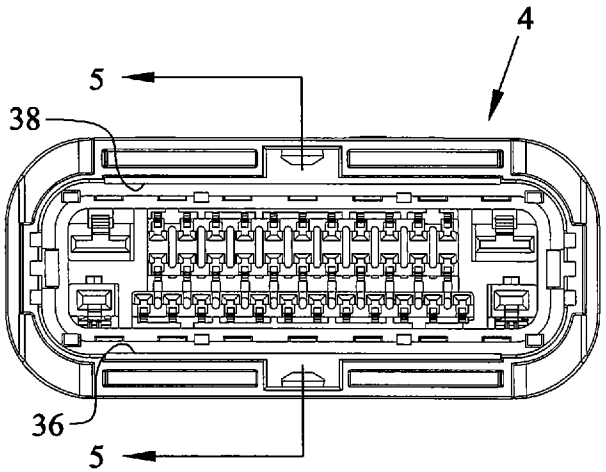
FIG. 4 shows a front end view of the plug housing of FIG. 3.
Figure 5:
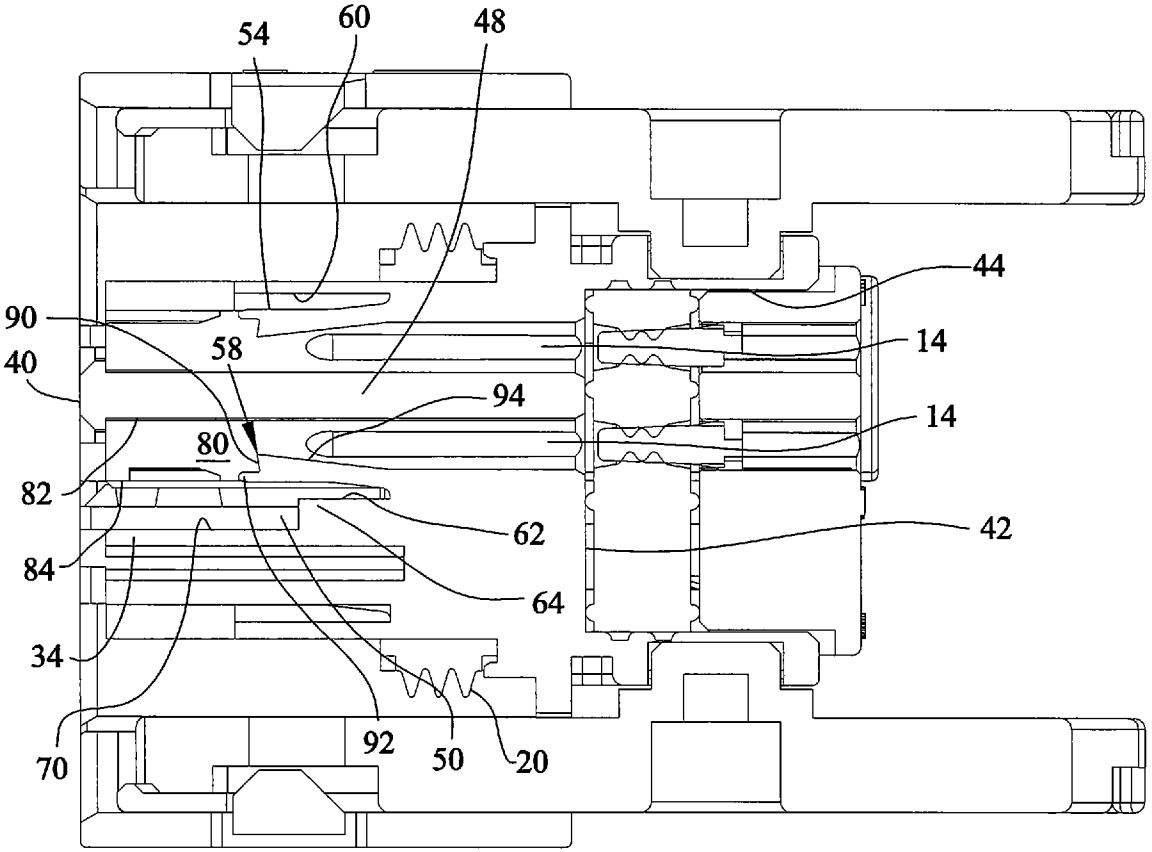
FIG. 5 shows a cross-sectional view through lines 5-5 of FIG. 4.
Figure 7:
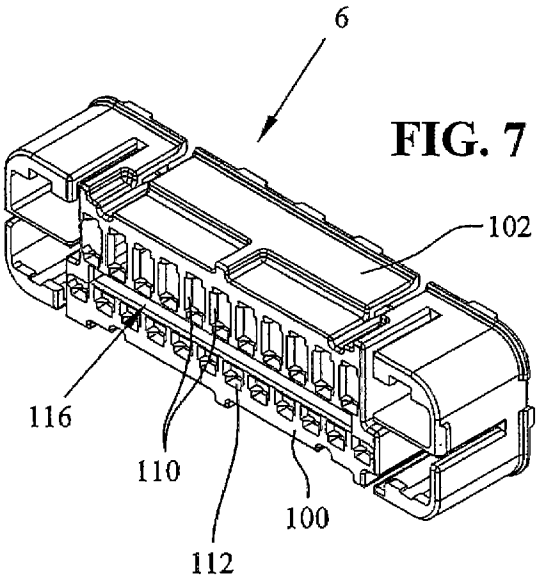
FIG. 7 shows a front perspective view of the TPA of FIG. 6.
Figure 6:
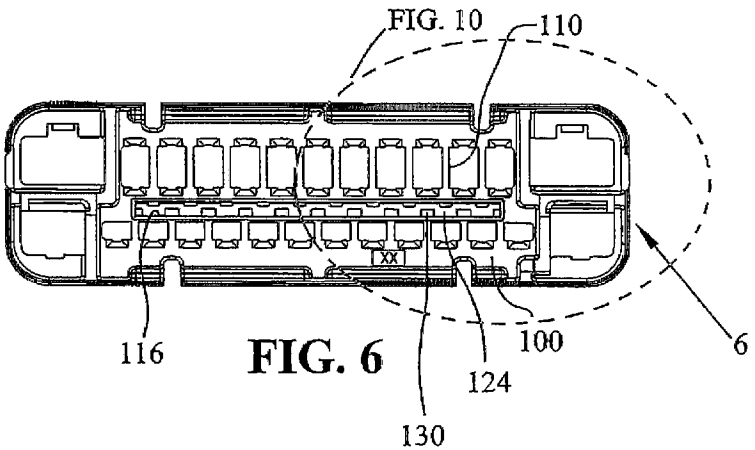
FIG. 6 shows a front view of the TPA.
Figure 8:
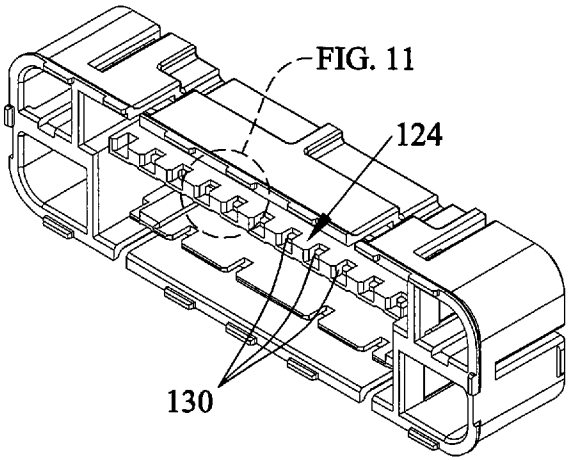
FIG. 8 shows a rear perspective view of the TPA of FIGS. 6 and 7.
Figure 9:
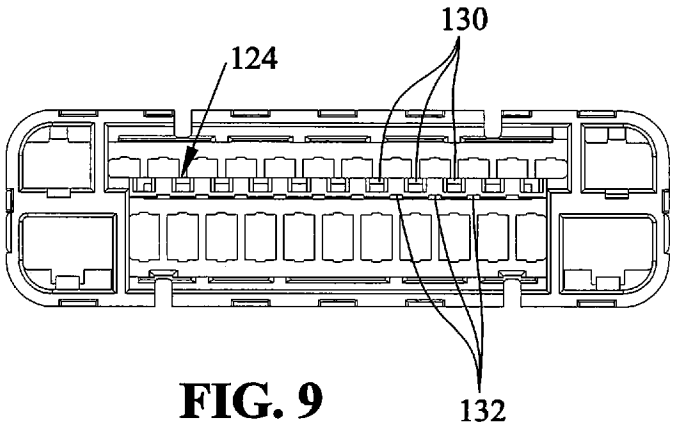
FIG. 9 shows a rear view of the TPA of FIG. 8.

With reference now to FIGS. 3-5, the plug housing 4 will be described in greater detail. As shown, plug housing 4 includes a shroud portion 30 which encircles housing upper and lower platforms 32 and 34 which provides support for terminal receiving passageways 14 as described above. The upper platform 32 includes a row of upper and a row of middle terminal receiving passageways 14. The lower platform 34 includes a row of lower terminal receiving passageways 14. Shroud portion 30 defines upper and lower planar wall portions 36 and 38 which define support for mating assist member 8 (FIG. 2).

Figure 12:
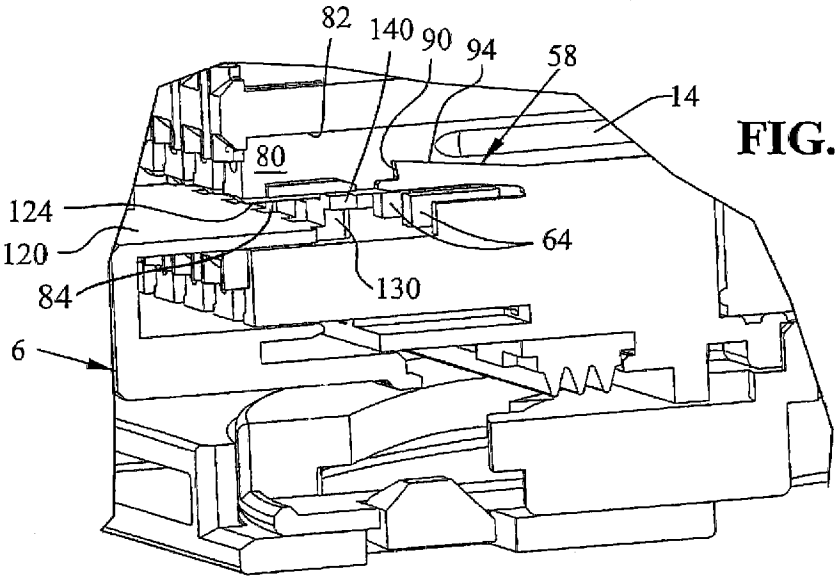
FIG. 12 shows a cross-sectional view showing the cooperation of the TPA and plug housing in a pre-locked position.
Figure 13:
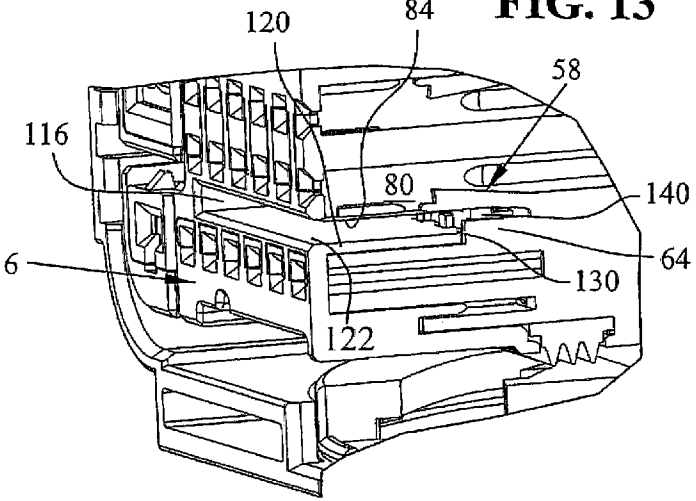
FIG. 13 shows the cross-sectional view of FIG. 12 with the TPA in the fully locked position.

With reference now to FIG. 5, plug housing 4 also includes a front face 40, rear face 42, an inner wall 44 and a central wall 48 which separates terminal receiving passageways 14. As shown best in FIGS. 3 and 5, a laterally extending channel 50 is adjacent to at least one row of terminal receiving passageways and is defined by housing upper and lower platforms 32 and 34 which provide access for an anti-scooping rib as further described herein. As shown, upper terminal receiving passageway 14 includes a locking latch 54 and the middle terminal receiving passageway includes a locking latch 58. As shown in FIG. 5, when a terminal is inserted into or removed from the terminal receiving passageway 14, the locking latch 54 may resile upwardly until it hits inner surface 60 of an overstress protection rib. Likewise, when a terminal is inserted into or removed from the middle terminal receiving passageway 14 the locking latch 58 may resile downwardly until it contacts an inner surface 62 of overstress protection rib 64. As shown, rib 64 extends from surface 70 of the lower housing platform 34 and is aligned with locking latch 58. As best shown in FIG. 12, an overstress protection rib 64 is positioned adjacent to each terminal receiving passageway 17. As shown in FIGS. 5, 12 and 13, each terminal receiving passageway 14 also includes a partial or side wall 80 extending from the front face 40 and defining the side of the terminal receiving passageway 14. The side wall 80 has an upper edge 82 and a lower edge at 84. Each locking latch 54, 58 further include a forwardly facing lock surface 90, a forwardly extending tongue 92 and a ramp surface 94.

Figure 10:
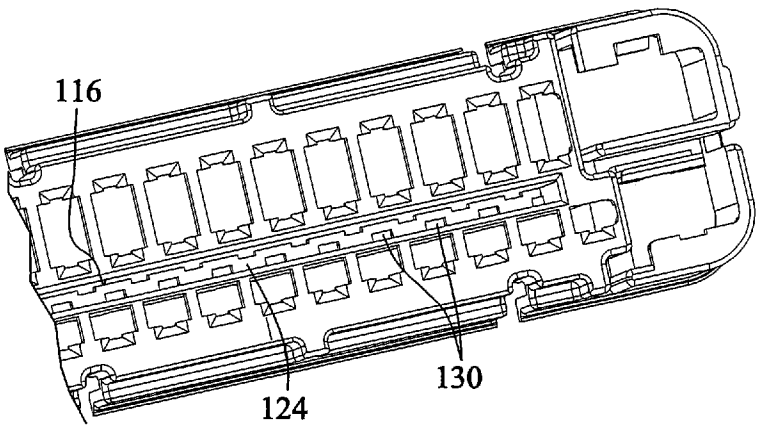
FIG. 10 shows an enlarged view of the portion denoted in FIG. 6.
Figure 11:
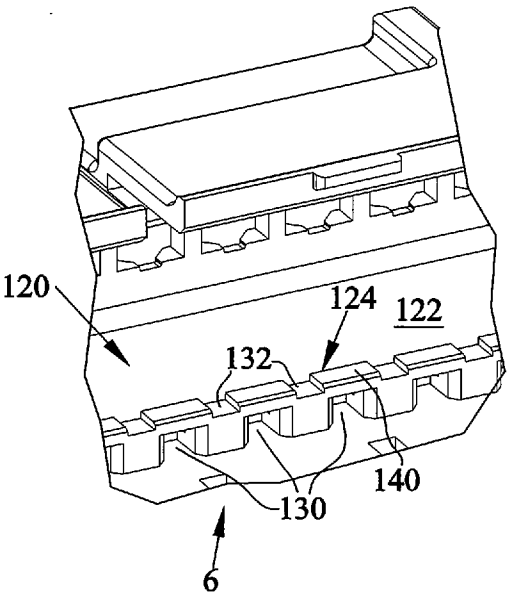
FIG. 11 shows an enlarged view of the portion denoted in FIG. 8.

With reference now to FIGS. 6-11, the TPA 6 will be described in greater detail. The TPA 6 includes a front face 100 and an outer shroud wall 102 which is receivable within shroud 30 (FIG. 3) of plug housing 4. The front face 100 includes apertures 110 configured to receive the terminal receiving passageways 14 in the upper platform 32 and openings 112 configured to receive terminal receiving passageways 14 in the lower platform 34. Front face 100 further includes a laterally extending opening 116 which aligns with laterally extending channel 50 (FIG. 3) as described herein. The TPA 6 includes a TPA plate or blade 120 (FIG. 11). The TPA blade 120 is defined by a generally flat plate 122 and a raised rear edge 124. The plate 122 defines a lower boundary of opening 116. The distance from the front face 100 to the rear edge 124 generally defines the depth of the opening 116. As shown in FIG. 11, the raised rear edge 124 of the TPA blade 120 is raised or vertically offset from the surface of the blade plate 122. The raised rear edge 124 includes raised blocks defining a plurality of slots 130. Extending from the opposite side of the TPA plate 122 are a plurality of projections 140 defining a plurality of grooves 132 between the projections 140. As shown best in FIG. 12, when the blade 120 is positioned within the channel 50 the plurality of slots 130 are aligned with ribs 64 (FIG. 5) and the plurality of grooves 132 are aligned with each partial wall 80 (FIG. 5) as described herein. As shown in FIGS. 10 and 11, the slots 130 are staggered related to the grooves 132.

With reference now to FIGS. 12 and 13, the operation of the TPA 6 and the plug housing 4 will be described in greater detail. With reference first to FIG. 12, TPA 6 is shown in a pre-locked position where rear edge 124 is positioned forward of ribs 64 and latch 58. A terminal may now be inserted into cavity 14 in a direction from right to left as shown in FIG. 12. The terminal biases latch 58 downwardly into the channel 50 by way of engagement of the terminal against surface 94. If the terminal is fully inserted, an edge of the terminal will engage locking surface 90 and the latch 58 will return to a position similar to that shown in FIG. 12. If the terminal is not fully inserted, the body of the terminal will continue to deflect latch 58 downwardly and any attempt to move TPA 6 to the right as viewed in FIG. 12, will cause projection 140 to engage the tongue 92 (or lock surface 90) preventing the full assembly of TPA 6.

When the terminal is fully positioned in terminal receiving passageway 14, the TPA 120 is moved further into engagement with the housing 6 which causes each of the slots 130 of the rear edge 124 to overlap a corresponding rib 64. As the rear edge 124 is positioned within the ribs 64, projections 140 are positioned underneath latch 58 as shown in FIG. 13. The positioning of the projections 140 under the latch ensures the terminal is fully mated in the housing 6 and prevents the deflection of the latch 58.

The proper function of the TPA requires the proper vertical positioning of the projections 140 to have proper engagement of the projections 140. As described above, the plate 122 of the TPA blade 120 is vertically offset from the projections. The offset allows the proper vertical positioning of the projections 140 as related to the latch 58. At the same time, since the vertical location of the blade plate 122 would interfere with the overstress protection ribs, slots 130 provide recesses to allow the TPA to be fully inserted into the channel 50.

As shown in FIG. 13, the opening 116 is defined by plate 122 and lower edge 84 of passageway side walls 80. Due to the offset, the blade plate 122 is positioned at the lower side of the channel allowing space for the opening 116. As assembled as shown in FIG. 13, connector assembly 2 may now be interconnected to a corresponding header having an anti-scoop rib. The anti-scoop rib would be profiled to be received in opening 116.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. An electrical connector, comprising:

a housing having a plurality of terminal receiving passageways positioned in at least one row, the passageways including a locking latch;

an overstress protection rib positioned adjacent each latch;

a channel extending through the housing and adjacent to the at least one row of terminal receiving passageways; and a terminal position assurance member (TPA) having a blade comprising a plate and a raised rear edge, the blade positioned within the channel so that the terminal position assurance member has a pre-locked position with the rear edge positioned forward of the latch allowing the latch to resile into the channel, and a fully locked position where the rear edge is positioned underneath the latch.

2. The electrical connector of claim 1, wherein the raised rear edge is vertically offset from the plate of the TPA blade.

3. The electrical connector of claim 1, wherein the rear edge includes projections which are positioned to engage the latches when the TPA is in the fully latched position.

4. The electrical connector of claim 1, wherein the slots are aligned with the overstress protection rib and the grooves are aligned with a side wall of the passageway.

5. The electrical connector of claim 3, wherein the rear edge includes a plurality of slots and a plurality of grooves extending from the opposite side of the blade plate.

6. The electrical connector of claim 1, wherein the terminal receiving passageway includes a lower edge and wherein the channel extends from the lower edge of the at least one row of terminal receiving passageways.

7. The electrical connector of claim 1, wherein the TPA defines an opening aligned with the channel to receive an anti-scooping rib of a mating connector.

8. The electrical connector of claim 7, wherein the terminal receiving passageway includes a lower edge and wherein the opening is defined by the lower edge of the at least one row of terminal receiving passageways and the plate of the TPA blade.

9. The electrical connector of claim 1, wherein the housing comprises at least two rows of terminal receiving passageways, and wherein the channel extends through a front wall of the housing and intermediate the at least two rows of terminal receiving passageways, the channel extending inwardly beyond the latches.

10. The electrical connector of claim 1, wherein the rear edge overlaps the overstress protection ribs.

11. The electrical connector of claim 1, wherein the rear edge includes projections which are received over the ribs and under the latches.

* * * * *